US009485808B2

(12) United States Patent
Shimizu et al.

(10) Patent No.: US 9,485,808 B2
(45) Date of Patent: Nov. 1, 2016

(54) SHEET HEATER

(71) Applicant: NISSAN MOTOR CO., LTD., Yokohama-shi, Kanagawa (JP)

(72) Inventors: Youji Shimizu, Yamato (JP); Hiroaki Miura, Kamakura (JP); Takashi Sunda, Sagamihara (JP); Yasuhiro Fukuyama, Yokohama (JP)

(73) Assignee: NISSAN MOTOR CO., LTD., Yokohama-Shi (JP)

( * ) Notice: Subject to any disclaimer, the term of this patent is extended or adjusted under 35 U.S.C. 154(b) by 701 days.

(21) Appl. No.: 13/856,078

(22) Filed: Apr. 3, 2013

(65) Prior Publication Data

US 2013/0264331 A1 Oct. 10, 2013

(30) Foreign Application Priority Data

Apr. 4, 2012 (JP) ..... 2012-085634

(51) Int. Cl.
*H05B 3/34* (2006.01)

(52) U.S. Cl.
CPC ..... *H05B 3/342* (2013.01); *H05B 2203/009* (2013.01); *H05B 2203/015* (2013.01)

(58) Field of Classification Search
CPC ..... H05B 3/34; H05B 3/342; H05B 3/345; H05B 3/347; H05B 3/356; H05B 3/565; H05B 1/0238; D04B 1/14
USPC ..... 219/202, 211, 217, 212, 528, 529, 537, 219/539, 544, 545, 549
See application file for complete search history.

(56) References Cited

U.S. PATENT DOCUMENTS 2,670,620 A * 3/1954 Goldstaub ..... H05B 3/345 219/212
4,713,531 A * 12/1987 Fennekels ..... H05B 3/342 219/211
5,422,462 A * 6/1995 Kishimoto ..... H05B 1/0272 219/529

(Continued)

FOREIGN PATENT DOCUMENTS

JP 2010-144312 A 7/2010

OTHER PUBLICATIONS

USPTO Notice of Allowance, U.S. Appl. No. 13/938,486, Oct. 5, 2015, 5 pages.

(Continued)

*Primary Examiner* — David Angwin
*Assistant Examiner* — Lawrence Samuels
(74) *Attorney, Agent, or Firm* — Foley & Lardner LLP

(57) ABSTRACT

A sheet heater includes a first fiber layer, a second fiber layer distanced from the first fiber layer, a third fiber layer disposed between the first and second fiber layers, and a controller operable to control heat generation. The first fiber layer is constituted of first conductive portions and first non-conductive portions. The second fiber layer is constituted of second conductive portions and second non-conductive portions. The third fiber layer includes functional layers each constituted of connecting yarns and non-functional layers arranged to insulate each of the functional layers from others of the functional layers. The controller applies voltage between the first and second conductive portions to heat the connecting yarns. According to the heater, a desired temperature distribution can be created on the heater by applying the voltage selectively to one target segment composed of the first conductive portion, the functional layer and the second conductive portion.

5 Claims, 6 Drawing Sheets

(56) References Cited

U.S. PATENT DOCUMENTS 5,484,983 A * 1/1996 Roell ..... D04B 1/12 219/528
6,216,546 B1 * 4/2001 Bahr ..... G01L 1/205 73/862.041
6,333,736 B1 * 12/2001 Sandbach ..... G06F 3/0414 178/18.03
6,452,138 B1 * 9/2002 Kochman ..... A41D 13/0051 219/529
6,608,438 B2 * 8/2003 Topelberg ..... H05B 33/26 313/491
7,144,830 B2 * 12/2006 Hill ..... D03D 1/0088 442/205
7,377,133 B2 * 5/2008 Sandbach ..... H01H 3/141 66/170
8,783,903 B2 * 7/2014 Bhattacharya ..... G09F 9/33 29/592.1
2003/0119391 A1 * 6/2003 Swallow ..... D02G 3/38 442/6
2003/0189037 A1 * 10/2003 Kochman ..... H05B 3/342 219/549
2005/0061802 A1 * 3/2005 Rock ..... D04B 1/04 219/545
2007/0210074 A1 * 9/2007 Maurer ..... B60N 2/5685 219/549
2008/0245786 A1 * 10/2008 Sharma ..... H05B 3/347 219/529
2008/0307899 A1 * 12/2008 Von Lilienfeld-Toal .... A61B 5/1036 73/862.68
2010/0013406 A1 * 1/2010 Bhattacharya ..... D03D 1/0088 315/291
2010/0154918 A1 * 6/2010 Li ..... D04B 1/14 139/412
2014/0014646 A1 1/2014 Shimizu et al.
2015/0000425 A1 * 1/2015 Miura ..... G01L 1/22 73/862.627

OTHER PUBLICATIONS

USPTO Office Action, U.S. Appl. No. 13/938,486, Feb. 17, 2015,7 pages.

* cited by examiner

SHEET HEATER

BACKGROUND OF THE INVENTION

1. Field of the Invention

The present invention relates to a sheet heater capable of selectively heating its segmented areas 2. Description of the Related Art Japanese Patent Application Publication No. 2010-144312 (FIG. 1) discloses a sheet heater including an electrically conductive yarn and a fabric. In the sheet heater, the conductive yarn is installed within the fabric to form an intermediate layer, and the fabric is heated by heat generated when electricity is applied to the conductive yarn. Since the conductive yarn is installed to form the intermediate layer within the fabric, an almost entire of the fabric can be heated uniformly.

SUMMARY OF THE INVENTION

However, when preparing a combined sheet heater having plural heated areas each of which is composed of the above-explained sheet heater and trying to heat the heated areas selectively, it is hard to create a desired temperature distribution on the combined sheet heater. When voltage is selectively applied to one of the heated areas to be heated, the voltage is subject to applied to others of the heated areas surrounding the one of the heated areas. Therefore, the others of the heated areas surrounding the one of the heated areas also generate heat. As a result, a desired temperature distribution is hard to be created on the combined sheet heater.

An object of the present invention is to provide a sheet heater that can create a desired temperature distribution thereon by applying voltage to a conductive fabric of one heated area to generate heat and preventing other heated areas surrounding the one heated area from generating heats by the voltage.

An aspect of the present invention provides a sheet heater that includes a first fiber layer; a second fiber layer distanced from the first fiber layer; a third fiber layer disposed between the first fiber layer and the second fiber layer; and a controller operable to control heat generation, wherein the first fiber layer is constituted of a plurality of first conductive portions and a plurality of first non-conductive portions that are arranged to electrically insulate each of first conductive portions from others of the first conductive portions, the second fiber layer is constituted of a plurality of second conductive portions and a plurality of second non-conductive portions that are arranged to electrically insulate each of second conductive portions from others of the second conductive portions, the third fiber layer that includes a plurality of functional layers each of which is constituted of connecting yarns electrically connect the plurality of first conductive portions and the plurality of second conductive portions with each other, and a plurality of non-functional layers that are arranged to electrically insulate each of functional layers from others of the functional layers, and the controller applies voltage between the first conductive portions and the second conductive portions to heat the connecting yarns.

BRIEF DESCRIPTION OF THE DRAWINGS

The invention will now be described with reference to the accompanying drawings wherein.

DESCRIPTION OF THE PREFERRED EMBODIMENT

Figure 1:
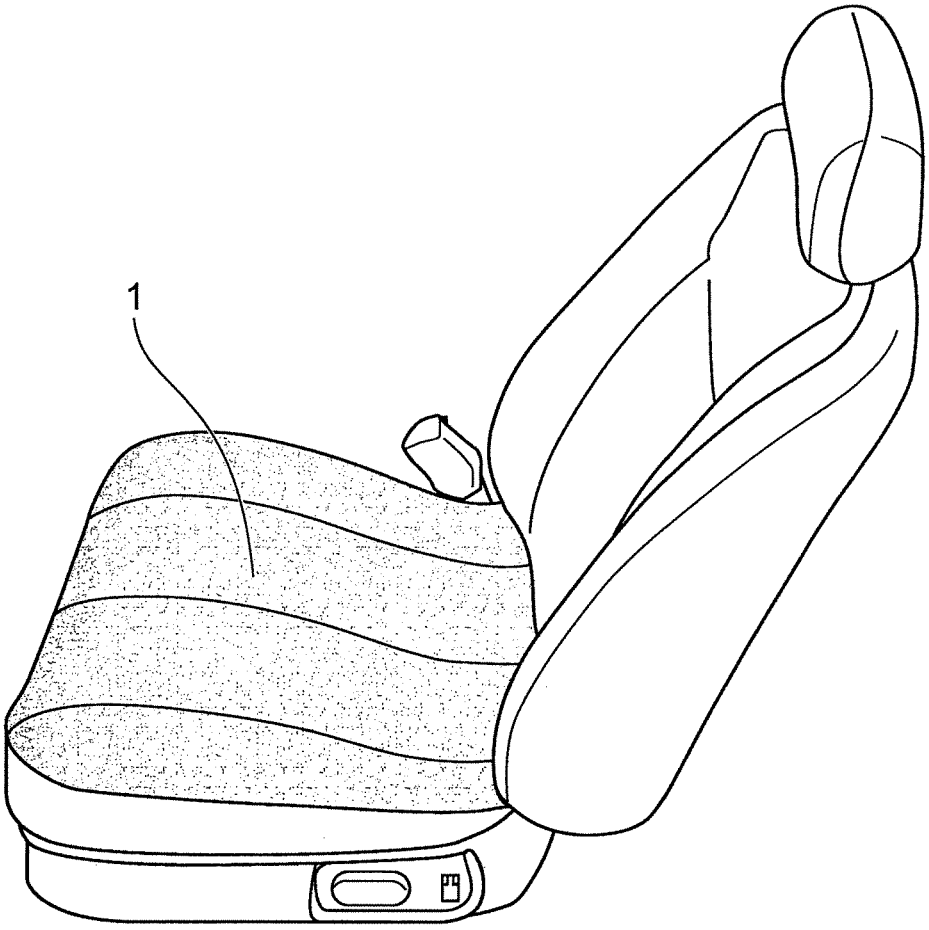
FIG. 1 is a perspective view of a seat that includes a sheet heater according to an embodiment as its seating face.

A sheet heater 1 according to an embodiment will be explained with reference to the drawing. In the following embodiment, the sheet heater 1 is used as a sheet heater for a seat in a vehicle, and installed at a seat face of the seat as shown in FIG. 1.

Figure 2:
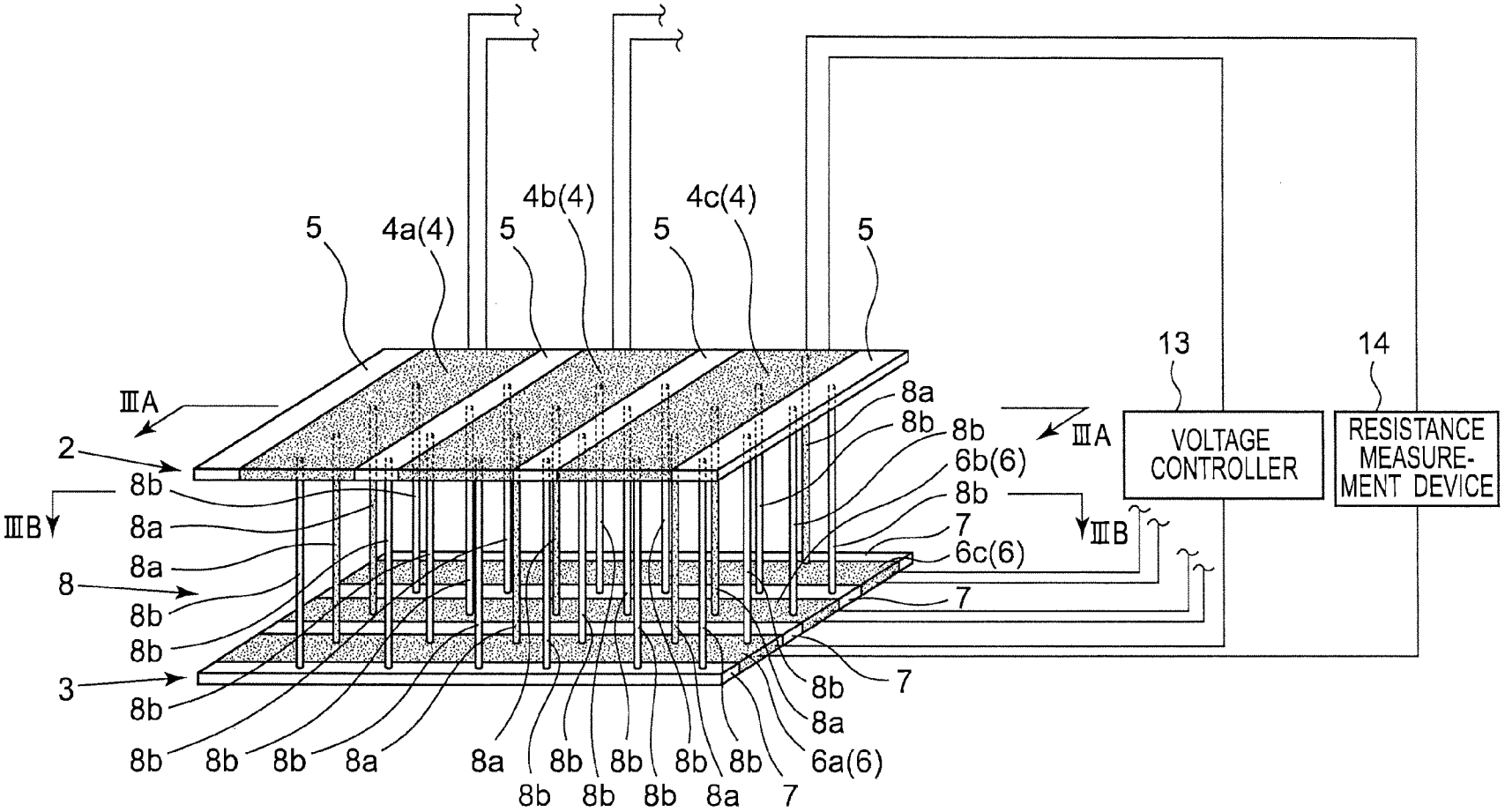
FIG. 2 is a schematic perspective view showing configuration of the sheet heater.

As shown in FIG. 2, the sheet heater 1 according to the present embodiment has a three-layer structure constituted of an upper layer 2 (served as a first fiber layer in claims), a lower layer 3 (served as a second fiber layer in claims), and an intermediate layer 8 (served as a third fiber layer in claims). The upper layer 2 is constituted by alternately aligning upper layer conductive portions 4 (served as first conductive portions in claims) and upper layer non-conductive portions 5 (served as first non-conductive portions in claims). Note that the upper layer conductive portions 4 and the upper layer non-conductive portions 5 are continuously woven while alternately changing over yarns that constitute them. The lower layer 3 is constituted by alternately aligning lower layer conductive portions 6 (served as second conductive portions in claims) and lower layer non-conductive portions 7 (served as second non-conductive portions in claims). Note that the lower layer conductive portions 6 and the lower layer non-conductive portions 7 are continuously woven while alternately changing over yarns that constitute them.

Each (width: 10 mm, length: 200 mm) of the upper layer conductive portions 4 (4*a*, 4*b*, 4*c* . . . ) is made of silver-coated fiber (manufactured by Shaoxing Yujia Textile Product Co., Ltd.). Each (width: 10 mm, length: 200 mm) of the lower layer conductive portions 6 (6*a*, 6*b*, 6*c* . . . ) is made of silver-coated fiber (manufactured by Shaoxing Yujia Textile Product Co., Ltd.). Each (width: 2 mm, length: 200 mm) of the upper layer non-conductive portions 5 (5*a*, 5*b*, 5*c* . . . ) is made of insulative polyester fiber (manufactured by Central Fiber materials Ltd.: Gunze Polina). Each (width: 2 mm, length: 200 mm) of the lower layer non-conductive portions 7 (7*a*, 7*b*, 7*c* . . . ) is made of non-conductive polyester fiber (manufactured by Central Fiber materials Ltd.: Gunze Polina).

Figure 3A:
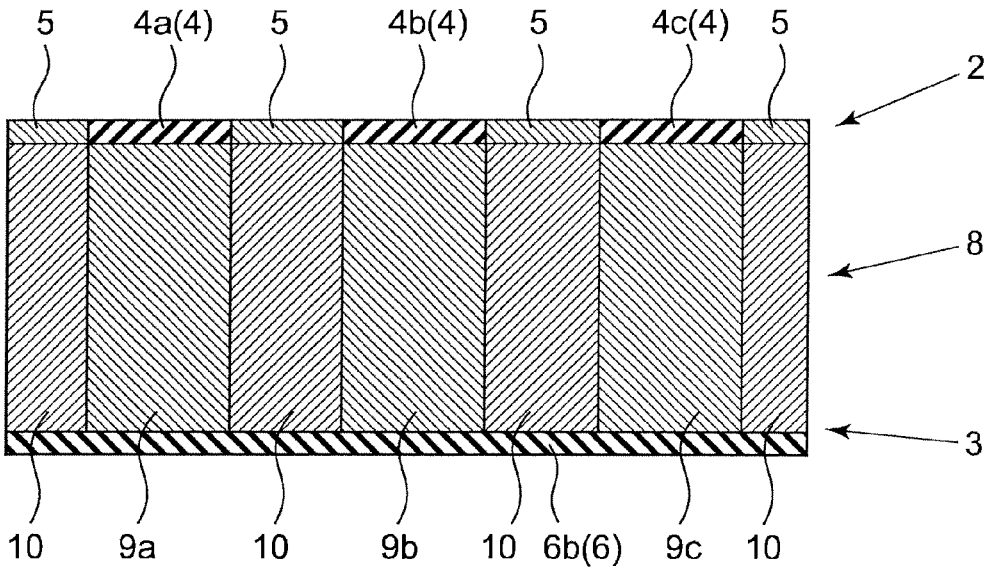
FIG. 3A is a cross-sectional view taken along a line IIIA-IIIA in FIG. 2.
Figure 3B:
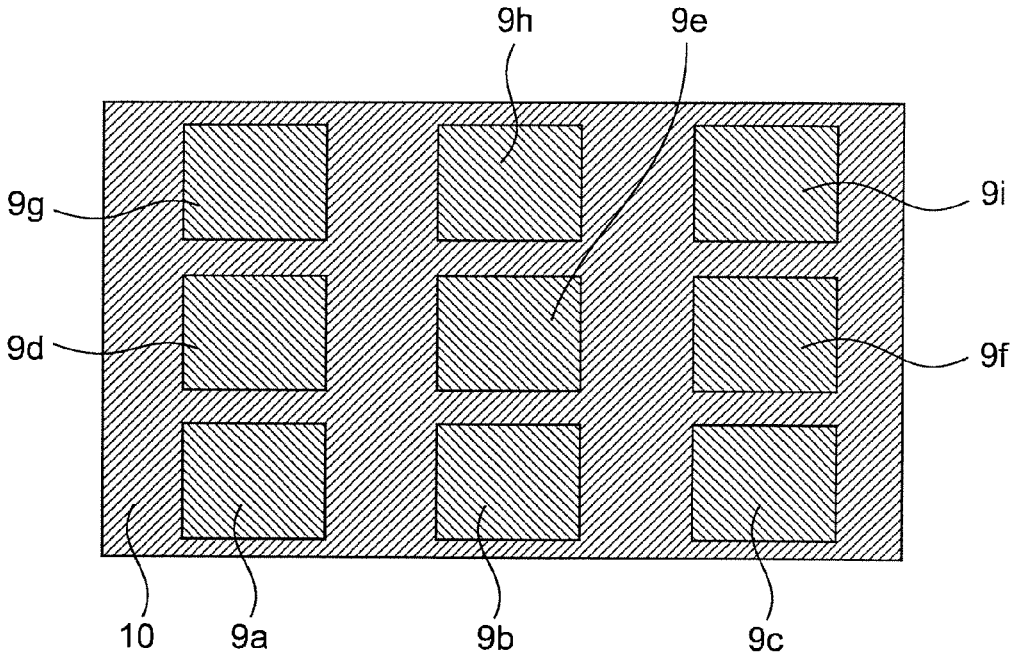
FIG. 3B is a cross-sectional view taken along a line IIIB-IIIB in FIG. 2.

As shown in FIG. 3A and FIG. 3B, the intermediate layer 8 includes inteimediate functional layers 9 (9*a*, 9*b*, 9*c* . . . ) (served as a functional layer in claims) and intermediate non-functional layers 10 (served as a non-functional layer in claims). Each of the intermediate functional layers 9 is made of a connecting yarn(s) 8*a* switched back between the upper layer conductive portion 4 and the lower layer conductive portion 6 many times so as to electrically connect the upper layer conductive portion 4 and the lower layer conductive portion 6 with each other (see FIG. 2 and FIG. 4A). Each of the intermediate non-functional layers 10 is made of an insulative yarn(s) 8*b* (served as an insulative material in claims) switched back between the upper layer non-conductive portion 5 and the lower layer non-conductive portion 7 many times so as to electrically connect the upper layer non-conductive portions 5 and the lower layer non-conductive portion 7 with each other (see FIG. 2 and FIG. 4A). As shown in FIG. 2, the longitudinal direction of the upper layer conductive portions 4 (4*a*, 4*b*, 4*c* . . . ) is almost perpendicular to the longitudinal direction of the lower layer conductive portions 6 (6*a*, 6*b*, 6*c* . . . ). Therefore, as shown in FIG. 3B, the intermediate functional layers 9*a* to 9*i* are arranged in a grid manner at areas where the upper layer conductive portions 4 (4*a*, 4*b*, 4*c* . . . ) and the lower layer conductive portions 6 (6*a*, 6*b*, 6*c* . . . ) overlap.

The connecting yarn 8*a* is a conductive polymer yarn having a 10 μm diameter that is made by a wet spinning method. Namely, the connecting yarn 8*a* (conductive polymer yarn) is extended from one of the upper layer conductive portion 4 and the lower layer conductive portion 6 to another of them. The connecting yarn 8*a* is manufactured by extruding fiber-spinning stock liquid from a microsyringe (manufactured by Ito Corporation: MS-GLL 100: inner diameter 260 μm) by a flow rate 2 μl/min into acetone (manufactured by WAKO-Chemicals: 019-00353) served as solvent. The fiber-spinning stock liquid is mixed liquid of once-strained aqueous dispersion of conductive polymer PEDOT/PSS (manufactured by Heraeus GmbH: Clevious P) and 7 wt % aqueous solution of polyvinyl alcohol [PVA] (Kanto Chemical Co,. Inc.). Electrical conductivity of the conductive polymer yarn (connecting yarn 8*a*) is tested with adherence to JIS (Japanese Industrial Standards) K 7194 [Testing method for resistivity of conductive plastics with a four-point probe array], so that its electrical resistivity is $10^{-1}$ Ω·cm.

When knitting the connecting yarn 8*a* by using a circular knitting machine manufactured by Precision Fukuhara Works, Ltd., the gauges, the number of feeder and so on for the circular knitting machine are adjusted so that thickness of the intermediate layer 8 becomes 10 mm and a proportion of a total area of the conductive polymer fiber (connecting yarn 8*a*) in a unit area of a cut surface when cut along a flat plane parallel to the upper layer 2 becomes 50%.

The insulative yarn 8*b* is made of polyester fiber (manufactured by Central Fiber materials Ltd.: Gunze Polina), similarly to the upper layer non-conductive portions 5.

The upper layer conductive portions 4 and the lower layer conductive portions 6 are connected to a voltage controller 13 (served as a controller in claims) and to a resistance measurement device 14 (served as a measurement instrument in claims), respectively.

A method for heating only the intermediate functional layer 9*a* (constituted of the connecting yarn(s) 8*a* connected with the upper layer conductive portion 4*a* and the lower layer conductive portion 6*a*) will be explained. In other words, only the intermediate functional layer 9*a* is selectively heated. Predetermined voltage is applied, by the voltage controller 13, between the upper layer conductive portion 4*a* and the lower layer conductive portion 6*a*. (No voltage is applied between the other upper layer conductive portions 4*b* and 4*c* and the other lower layer conductive portion 6*b* and 6*c*.) Since the connecting yarn 8*a* extended between the upper layer conductive portion 4*a* and the lower layer conductive portion 6*a* has a high resistance value, the intermediate functional layer 9*a* between the upper layer conductive portion 4*a* and the lower layer conductive portion 6*a* produces heat.

At this time, the intermediate functional layer 9*a* neighbors the insulative intermediate non-functional layers 10, so that the intermediate functional layer 9*a* is insulated with the intermediate non-functional layers 10 surrounding it (see FIG. 3B).

Therefore, the electrical current due to the applied voltage does not flow through the insulative intermediate non-functional layers 10, and thereby the intermediate non-functional layers 10 produce no heat. Each of the other intermediate functional layers 9*b* to 9*i* also neighbors the insulative intermediate non-functional layers 10. In addition, one of upper or lower ends of each of the other intermediate functional layers 9*b* to 9*i* contacts with one of the upper layer conductive portions 4*b* and 4*c* or the lower layer conductive portion 6*b* and 6*c*. Therefore, the electrical current due to the applied voltage does not flow through any of the intermediate functional layers 9*b* to 9*i*, and thereby the intermediate functional layers 9*b* to 9*i* produce no heat. Namely, only the intermediate functional layer 9*a* produces heat (is heated by the applied voltage). Each of the other intermediate functional layers 9*b* to 9*i* can be heated selectively, similarly to the above-explained method for heating the intermediate functional layer 9*a*.

Figure 4A:
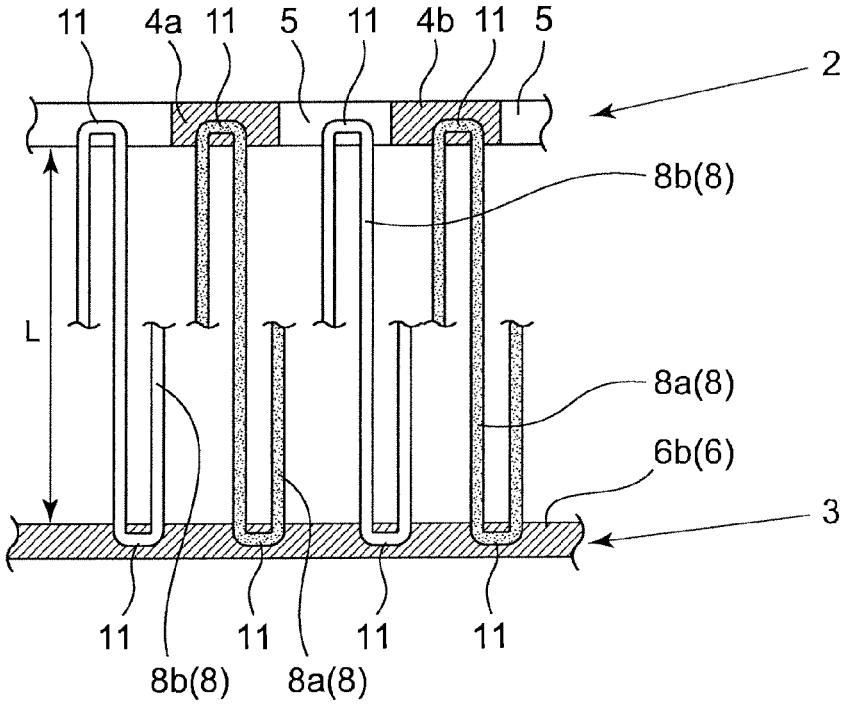
FIG. 4A is a cross-sectional view associated with FIG. 3A when no pressure is applied.

Further, a method for measuring a pressure applied to the upper layer conductive portion 4*b* from the outside toward the lower layer conductive portion 6*b* by using the sheet heater as a pressure sensor will explained with reference to FIG. 4A and FIG. 4B. As shown in FIG. 4A, a length L of a connecting yarn 8*a* between the upper layer conductive portion 4*b* and the lower layer conductive portion 6*b* (no pressure is applied) is expressed by a following equation (1) as a function of an applied pressure F. A coefficient α takes a value identical to the reciprocal of the spring constant of the sheet heater 1 along the compression direction.

$$L=\alpha F \tag{1}$$

L: length of the connecting yarn 8*a* [mm]

F: pressure applied to the sheet heater 1 [Pa]

α: coefficient [mm/Pa]

Here, a relation of an electrical resistance value R between the upper layer conductive portion 4*b* and the lower layer conductive portion 6*b*, an electrical resistivity ρ, the length L of the connecting yarn 8*a*, and a sectional area of the connecting yarn 8*a* is expressed by a following equation (2).

$$R=\rho L/S \tag{2}$$

R: resistance value [kΩ]

ρ: resistivity [Ω·mm]

L: length of the connecting yarn 8*a* [mm]

S: sectional area of the connecting yarn 8*a* [$mm^2$]

When no pressure is applied to the upper layer conductive portion 4*b*, the connecting yarn 8*a* between the upper layer conductive portion 4*b* and the lower layer conductive portion 6*b* keeps a predefined self-reliant length L as shown in FIG. 4A. However, when a pressure F is applied to the upper layer conductive portion 4*b*, the upper layer conductive portion 4*b* is bent downward and thereby the connecting yarn 8*a* contacts with contact points B with the upper layer conductive portion 4*b* and the lower layer conductive portion 6*b*, respectively, as shown in FIG. 4B. Namely, the connecting yarn 8*a* (conductive polymer yarn) shortly-contacts with the upper layer conductive portion 4*b* and the lower layer conductive portion 6*b*. At this time, an electricity path (shown by a dotted line in FIG. 4B) between the upper layer conductive portion 4*b* and the lower layer conductive portion 6*b* takes a length L'. This length L' becomes shorter than the length L when the pressure F is not applied. If the pressure F applied to the upper layer conductive portion 4*b* is more higher, the upper layer conductive portion 4*b* is bent downward further and thereby the electricity path of the connecting yarn 8*a* takes a shorter length L" as shown in FIG. 4B. This length L" becomes shorter than the above-explained length L'. Therefore, the resistance value R between the upper layer conductive portion 4*b* and the lower layer conductive portion 6*b* bears a proportionality relation to the (electrically-effective) length L (L', L") of the connecting yarn 8*a*, and takes the lower value, the higher pressure is applied to the upper layer conductive portion 4*b*.

Figure 5:
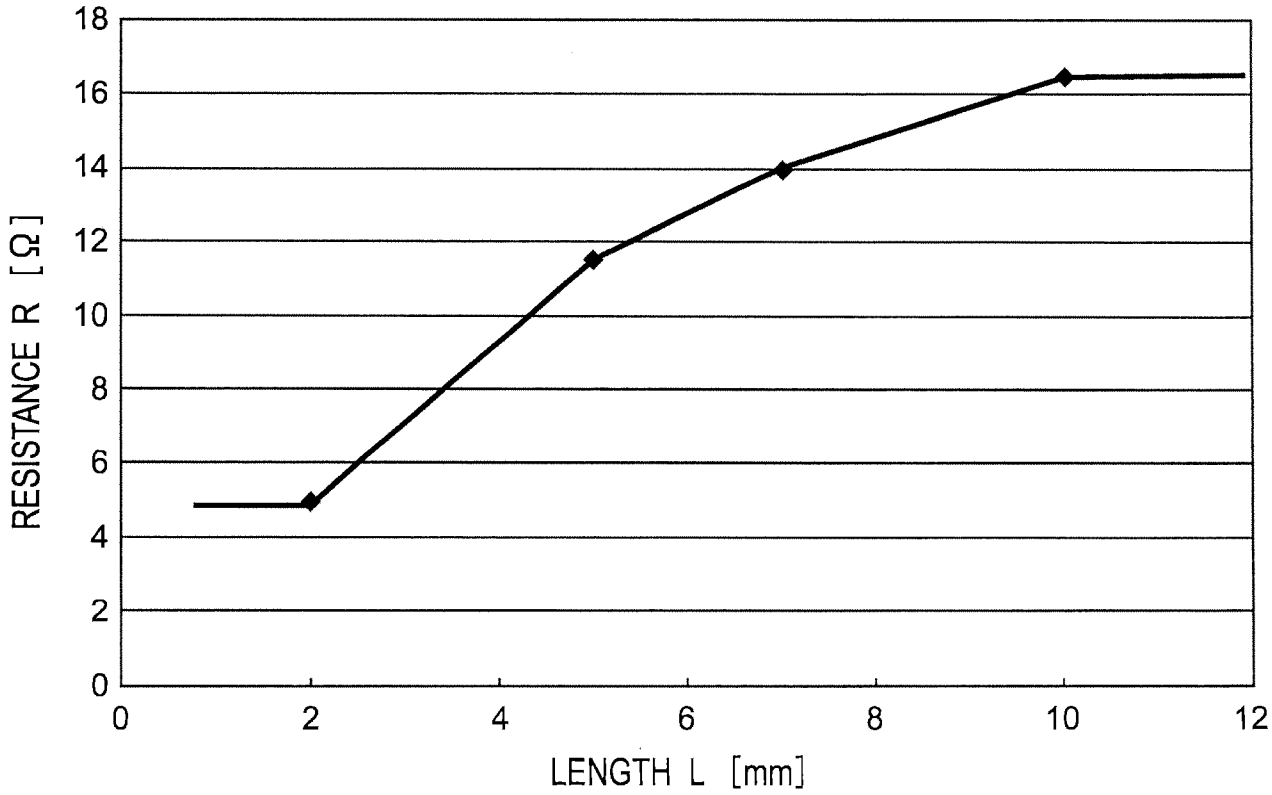
FIG. 5 is a graph showing a relation between a length of a connecting yarn and an electrical resistance value.

As a result, the length L (proportional to the applied pressure F) and the resistance value R between the upper layer conductive portion 4*b* and the lower layer conductive portion 6*b* continuously change as shown in FIG. 5. Therefore, it becomes possible to calculate the pressure F (proportional to the length L) from the resistance value R, so that the intermediate functional layer can function as a pressure sensor As explained above, when applying voltage to a selected intermediate functional layer to heat it, fibers disposed between the selected intermediate functional layer and other non-selected intermediate are prevented form generating heat. Therefore, it can be prevented that the fibers excluding fibers in the selected intermediate functional layer generate heat, and thereby it can be prevented that an undesired area(s) is heated. As a result, a desired temperature distribution can be created on the sheet heater. In addition, a resistance value between the upper layer conductive portion(s) 4 and the lower layer conductive portion(s) 6 bears a proportionality relation to an applied pressure, so that it is possible to provide a pressure sensor function to the sheet heater by the resistance measurement device 14.

As explained above, the upper layer conductive portions 4 and the lower layer conductive portions 6 are connected to the voltage controller 13 and the resistance measurement device 14, respectively. Therefore, it is possible to measure an applied pressure by measuring a resistance value of the intermediate functional layer 9*a* by the resistance measurement device 14 while the intermediate functional layer 9*a* is generating heat by being applied with voltage by the voltage controller 13. Similarly, it is also possible to measure a pressure applied to any one of the intermediate functional layer 9*b* to 9*i* while the intermediate functional layer 9*a* is generating heat.

According to the above embodiment, the insulative intermediate non-functional layers 10 are provided so as to surround the conductive intermediate functional layers 9 made of the connecting yarns 8*a* that electrically connect the upper layer conductive portions (first conductive portions) 4 in the upper layer (first fiber layer) 2 and the lower layer conductive portions (second conductive portion) 6 in the lower layer (second fiber layer) 3 with each other. Therefore, when applying voltage to a selected intermediate functional layer 9 between the upper layer conductive portions 4 and the lower layer conductive portions 6, the connecting yarn(s) 8*a* constitutes the selected intermediate functional layer 9 generates heat. On the other hand, insulative intermediate non-functional layers 10 disposed between the selected intermediate functional layer 9 and other non-selected intermediate functional layers 9 do not generates heat due to their insulation properties. Therefore, it can be prevented that fibers excluding fibers in the selected intermediate functional layer 9 generate heat, and thereby it can be prevented that an undesired area(s) is heated. As a result, a desired temperature distribution can be created on the sheet heater 1.

While embodiments of the present invention have been described hereinabove, these embodiments are merely illustration described for the purpose of facilitating the understanding of the present invention, and the present invention is not limited to the embodiments. The technical scope of the present invention is not limited to the specific technical matters disclosed in the embodiments but includes various modifications, changes, alternative techniques, and the like which can readily be conceived therefrom.

For example, the sheet heater according to the present invention may be applied not only to a sheet heater for a seat in a vehicle, but also to various usages such as a cushion cover and an electrical carpet, for example In the above embodiment, the intermediate non-functional layer(s) 10 is made of the insulative yarn 8*b*. However, the intermediate non-functional layer(s) 10 may be formed as an insulative hollow layer filled with gas such as air (i.e. the intermediate non-functional layers 10 shown in FIG. 3A and FIG. 3B are filled with gas in this case).

In this case, if a volume of its hollow space is excessively large, surface stiffness of the sheet heater 1 against an applied pressure becomes non-uniform and thereby the non-uniform surface stiffness may bring uncomfortable feelings when the sheet heater 1 is used in a seat, a bed or the like. Therefore, it is desired to give a large volume(s) to the intermediate functional layer(s) 9 and to allocate a small volume(s) to the intermediate non-functional layer(s) 10.

In the above embodiment, the upper layer conductive portion(s) 4 and the lower layer conductive portion(s) 6 are made of silver-coated fiber, and the connecting yarn 8*a* is made of a conductive polymer fiber. As a conductive material, following materials may be used: a metallic wire made of gold, silver, copper, nickel chrome alloy or the like, a carbon-based material such as carbon graphite, a particle material made of semiconductor such as metallic oxide or made of metal, and a conductive polymer material such as acetylenic polymers, polymers with a complex 5-men circle system, phenilenic polymers, anilinic polymers or the like. As a carbon-based material, yarns made by spinning with a mixture of carbon fibers, carbon particles or the like may be used in addition to generally sold products such as carbon fibers (Torayca [registered trade mark] manufactured by Toray Industries, Inc., Donacarbo manufactured by Osaka Gas Chemicals Co, Ltd., or the like). As a particle material, carbon-based powders such as carbon black (Ketjenblack manufactured by Lion Corporation), metal fine particles made of iron, aluminum and so on, or the like may be used. In addition, semi-conductive fine particles made of tin oxide ($SnO_2$), zinc oxide (ZnO) or the like may be also used as a particle material. Note that the conductive polymer yarn (uses as the connecting yarn 8*a*) may be made of any of the above conductive materials excluding the referred metals used singly. Used may be a material made of any of the above conductive materials used singly, a material whose surface is coated with the any of the above conductive materials by vapor deposition or embrocation, and a material in which any of the above conductive materials is used as a core and its surface is coated with another material.

It is preferable to use carbon fiber or carbon fiber as a conductive material among the above materials in view of ease of purchasing in markets, specific weight and so on. In addition, the conductive material may be made of a singly-used material or plural materials.

It is preferable that the upper layer 2 and the lower layer 3 themselves is made of fibers in order to provide air permeability. Note that the upper layer conductive portion(s) 4 and the lower layer conductive portion(s) 6 may be made by pasting a conductive coating-material uniformly so as to form swaths on the upper layer 2 and the lower layer 3 or on entire surfaces of the upper layer 2 and the lower layer 3. As the conductive coating-material, Dotite [registered trade mark] manufactured by Fujikura Kasei Co., Ltd. can be used.

In order to prevent degradation of comfort due to partial differences of hardness as the sheet heater 1, used may be a metallic wire or a conductive fiber (e.g. twist yarn made of metal such as nickel) that has a cross-sectional area almost equal to that of a fiber/yarn constituting the upper layer conductive portion(s) 4, the lower layer conductive portion(s) 6, the upper layer 2, the lower layer 3, and the intermediate layer 8.

For the upper layer non-conductive portion(s) 5, the lower layer non-conductive portion(s) 7 and the intermediate non-functional layer(s) 10 that are insulative portions, it is preferable to use fibers made of commonly used resin, by using singly or in combination, such as polyamide (e.g. Nylon 6 and Nylon 6-6), polyethylene terephthalate, polybutylene terephthalate, and polyacrylonitrile in view of costs and practicality.

As the voltage controller 13 used for heating a target area or the resistance measurement device 14 for measuring a resistant value of a target area, commonly used devices such as a switching element and a relay may be used singly or in combination. A term "electrical resistivity" in the above descriptions refers to resistivity measured by JIS K 7194 [Testing method for resistivity of conductive plastics with a four-point probe array]. A term "insulative" means electrically insulative property, and generally means to have resistivity larger than $10^6$ Ω·cm.

A term "yarn" in the above descriptions refers to a yarn made by a melt spinning method, a wet spinning method, an electro spinning method, a yarn made by cutting a film out to form plural yarns, or the like. A yarn whose diameter or width is several micrometers to several hundred micrometers is preferable in view of forming a woven fabric or a knitted fabric (ease of weaving or knitting, softness of a woven sheet or a knitted sheet, ease of handling as a fabric, and so on). By bundling several dozen to several thousand of the above yarns, the bundled yarns become ease to handle. When bundling the yarns, they may be twisted.

A term "synthetic fiber/yarn" means a fiber/yarn made of commonly used resin (such as Nylon 6 and Nylon 6-6), polyethylene terephthalate, polybutylene terephthalate, and polyacrylonitrile) by using singly or in combination.

It is physically possible to use a natural fiber/yarn. But, a synthetic fiber/yarn is preferable in view of performance of a heater, because quality of a synthetic fiber/yarn (such as its diameter and its variability of physical property along its length) is stable. In addition, a synthetic fiber/yarn is preferable also in view of costs and availability.

Figure 4B:
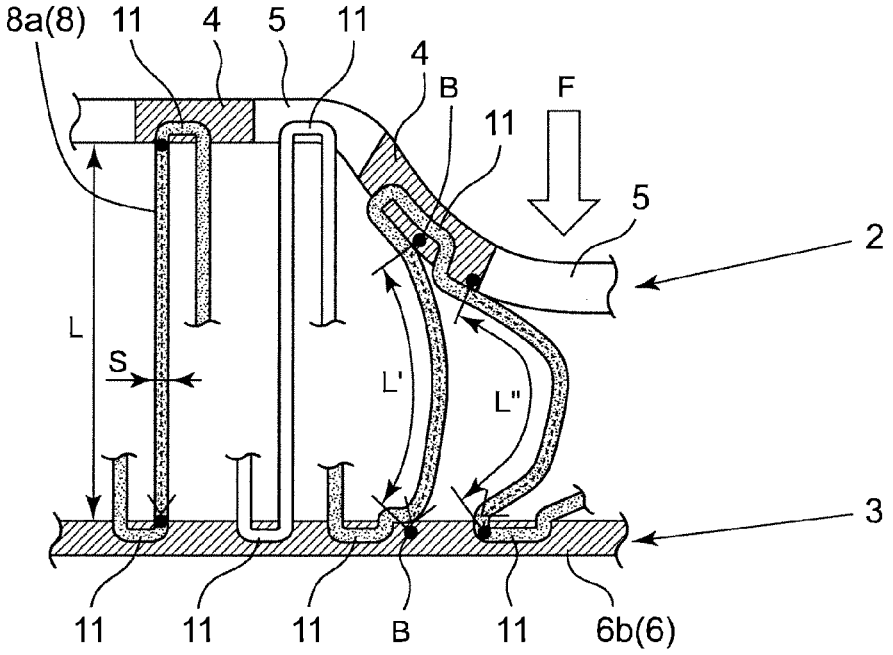
FIG. 4B is a cross-sectional view associated with FIG. 3A while pressure is being applied.
Figure 6A:
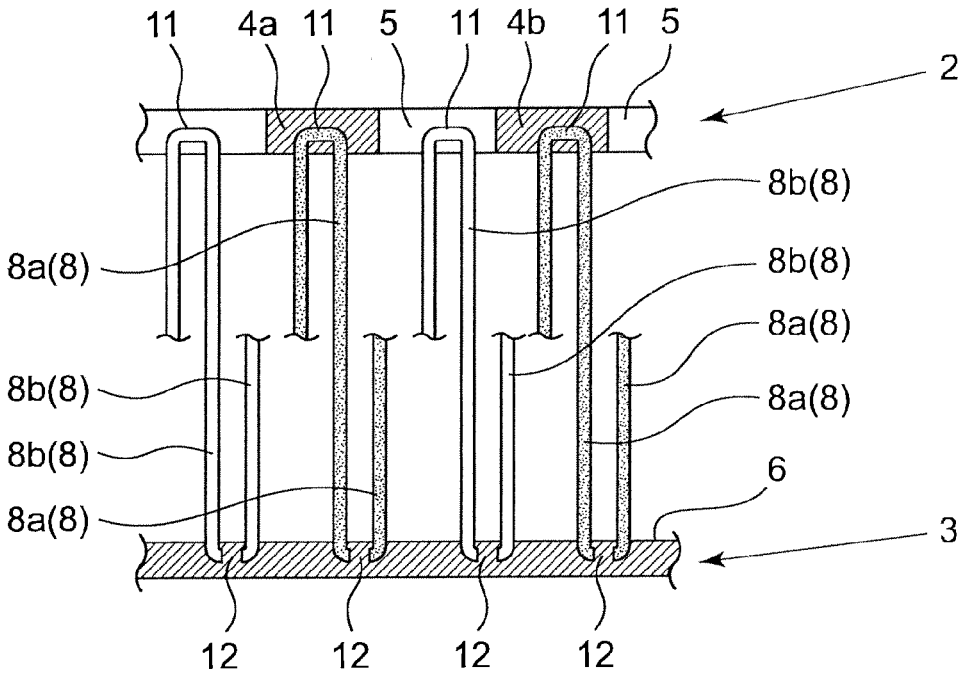
FIG. 6A is a cross-sectional view corresponding to FIG. 4A showing a first modification of the connecting yarn.
Figure 6B:
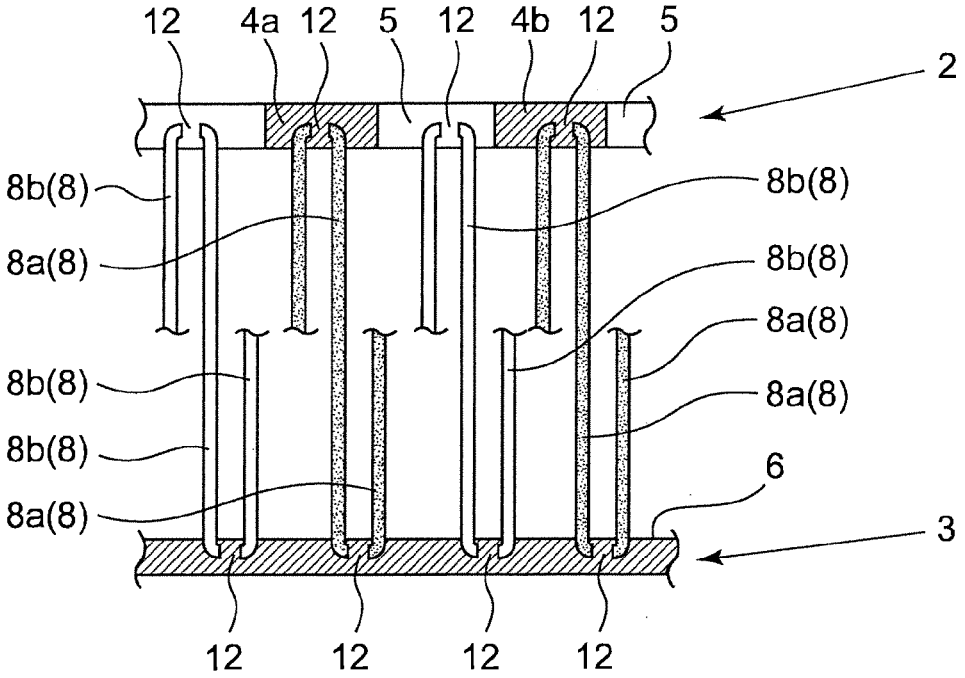
FIG. 6B is a cross-sectional view corresponding to FIG. 4A showing a second modification of the connecting yarn.

In the above embodiment, the connecting yarn 8*a* exists continuously (is not divided) at its connecting portions 11 with the upper layer 2 and/or the lower layer 3 as shown in FIG. 4A and FIG. 4B. However, the connecting yarn 8*a* may be divided in the upper layer 2 and/or the lower layer 3 to form cut ends 12 as shown in FIG. 6A and FIG. 6B. In this case, the cut ends 12 must be fixed with the upper layer 2 and/or the lower layer 3 in some way. Similarly, the insulative yarn 8*b* may be also divided in the upper layer 2 and/or the lower layer 3 to form cut ends 12 as shown in FIG. 6A and FIG. 6B.

The entire content of Japanese Patent Application No. 2012-85634 (filed on Apr. 4, 2012) is incorporated herein by reference.

What is claimed is:

1. A sheet heater comprising:

a first fiber layer comprising a plurality of first conductive portions and a plurality of first non-conductive portions that are arranged to electrically insulate each of the plurality of first conductive portions from others of the plurality of first conductive portions;

a second fiber layer distanced from the first fiber layer comprising a plurality of second conductive portions and a plurality of second non-conductive portions that are arranged to electrically insulate each of the plurality of second conductive portions from others of the plurality of second conductive portions;

a third fiber layer disposed between the first fiber layer and the second fiber layer, the third fiber layer comprising a plurality of functional layers having connecting yarns that electrically connect the plurality of first conductive portions to the plurality of second conductive portions, and a plurality of non-functional layers that are arranged to electrically insulate each of the plurality of functional layers from others of the plurality of functional layers;

a controller configured to control heat generation; and a measurement instrument configured to measure an electrical resistance between the plurality of first conductive portions and the plurality of second conductive portions, wherein the controller applies a voltage between the plurality of first conductive portions and the plurality of second conductive portions such that the connecting yarns generate heat, wherein the connecting yarns are configured such that, when the connecting yarns are bent due to a pressure applied to the first fiber layer or the second fiber layer, at least one intermediate point of the bent connecting yarns contacts the plurality of first conductive portions or the plurality of second conductive portions to reduce the electrical resistance, wherein a longitudinal direction of the plurality of first conductive portions is perpendicular to a corresponding longitudinal direction of the plurality of second conductive portions, and wherein the plurality of first conductive portions and the plurality of first non-conductive portions are alternately arranged, and wherein the plurality of second conductive portions and the plurality of second non-conductive portions are alternately arranged.

2. The sheet heater according to claim 1, wherein each of the plurality of non-functional layers comprises an insulative material.

3. The sheet heater according to claim 2, wherein the insulative material is an insulative yarn.

4. The sheet heater according to claim 2, wherein the insulative material is gas.

5. The sheet heater according to claim 1, wherein a first end of each of the connecting yarns is attached to one of the plurality of first conductive portions and a second end of each of the connecting yarns is attached to one of the plurality of second conductive portions.

* * * * *